US008783403B1

(12) United States Patent
Robbins

(10) Patent No.: US 8,783,403 B1
(45) Date of Patent: Jul. 22, 2014

(54) TRANSFER ACCESSIBLE VEHICLE FOR DISABLED PERSON

(71) Applicant: Llyod L. Robbins, Highland, UT (US)

(72) Inventor: Llyod L. Robbins, Highland, UT (US)

( * ) Notice: Subject to any disclaimer, the term of this patent is extended or adjusted under 35 U.S.C. 154(b) by 0 days.

(21) Appl. No.: 14/076,729

(22) Filed: Nov. 11, 2013

Related U.S. Application Data

(60) Provisional application No. 61/750,160, filed on Jan. 8, 2013.

(51) Int. Cl.
*A61G 7/10* (2006.01)

(52) U.S. Cl.
USPC ..... 180/216; 180/19.2

(58) Field of Classification Search
USPC ..... 180/210–216, 19.1, 19.2
See application file for complete search history.

(56) References Cited

U.S. PATENT DOCUMENTS

| | | | | | |
|---|---|---|---|---|---|
| 2,609,862 | A | | 9/1952 | Pratt | |
| 3,147,039 | A | | 9/1964 | Smith et al. | |
| 4,076,304 | A | | 2/1978 | Deucher | |
| 4,125,908 | A | | 11/1978 | Vail et al. | |
| 4,570,739 | A | * | 2/1986 | Kramer | 180/216 |
| 4,613,151 | A | * | 9/1986 | Kielczewski | 280/650 |
| 4,633,538 | A | * | 1/1987 | James | 5/83.1 |
| 4,805,248 | A | | 2/1989 | Lunau | |
| 4,846,295 | A | * | 7/1989 | Shepard et al. | 180/68.5 |
| 4,862,997 | A | * | 9/1989 | Eberle | 182/148 |
| 4,987,622 | A | | 1/1991 | Shockey | |
| 5,036,938 | A | * | 8/1991 | Blount et al. | 180/208 |
| 5,096,008 | A | | 3/1992 | Mankowski | |
| 5,096,088 | A | | 3/1992 | Grossi | |
| 5,108,202 | A | | 4/1992 | Smith | |
| 5,233,708 | A | | 8/1993 | Winston, Sr. | |
| 5,255,934 | A | * | 10/1993 | Wilson | 280/657 |
| 5,489,258 | A | | 2/1996 | Wohnsen et al. | |
| 5,708,993 | A | * | 1/1998 | Campbell et al. | 5/86.1 |
| 5,758,371 | A | * | 6/1998 | VanDyke et al. | 5/86.1 |
| 5,884,563 | A | | 3/1999 | Sheldon et al. | |
| 5,984,338 | A | | 11/1999 | Meyer | |
| 6,074,306 | A | | 6/2000 | Behringer | |
| 6,092,247 | A | * | 7/2000 | Wilson | 5/86.1 |
| 6,308,981 | B1 | | 10/2001 | Proehl | |
| 6,427,270 | B1 | * | 8/2002 | Blevins et al. | 5/613 |
| 6,533,523 | B1 | | 3/2003 | Zamotin | |
| 6,691,349 | B2 | * | 2/2004 | Blevins | 5/613 |
| 7,069,608 | B2 | | 7/2006 | Failor et al. | |
| 7,234,557 | B2 | * | 6/2007 | Chen | 180/208 |
| 7,611,203 | B1 | * | 11/2009 | Roberts et al. | 297/344.2 |
| 7,661,696 | B1 | | 2/2010 | Acebo | |
| 7,716,759 | B2 | * | 5/2010 | Wilder | 5/83.1 |

(Continued)

FOREIGN PATENT DOCUMENTS

| | | |
|---|---|---|
| FR | 2697418 | 5/1994 |
| GB | 2381256 | 9/2001 |
| WO | WO 02/47513 | 6/2002 |

*Primary Examiner* — Kevin Hurley
(74) *Attorney, Agent, or Firm* — Novak Druce Connolly Bove + Quigg LLP

(57) ABSTRACT

An electrically powered self propelled transfer accessible vehicle having a chair which can be vertically positioned by a lifting frame on the vehicle controlled by an operator of the vehicle to permit a disabled person to move from a wheelchair onto the vehicle chair and then repositioned for the disabled person to enter a ride or attraction at an amusement park or to receive physical therapy.

18 Claims, 13 Drawing Sheets

(56) References Cited

U.S. PATENT DOCUMENTS

| | | | | |
|---|---|---|---|---|
| 8,104,554 | B2 | 1/2012 | Graham | |
| 8,123,664 | B2 | 2/2012 | Lokken et al. | |
| 8,316,480 | B2 * | 11/2012 | Burak et al. | 5/87.1 |
| 2010/0138990 | A1 | 6/2010 | Van Oirschot | |

* cited by examiner

TRANSFER ACCESSIBLE VEHICLE FOR DISABLED PERSON

This application claims the benefit of U.S. Provisional Application No. 61/750,160, filed Nov. 8, 2013, and entitled "Transfer Accessible Vehicle for Disabled Person," which is incorporated herein by reference.

FIELD OF THE INVENTION

The present invention relates generally to the movement of disabled persons from a wheel chair to a desired destination and more specifically to such movement when the desired destination is an amusement park ride or for physical therapy treatment.

BACKGROUND OF THE INVENTION

Theme or amusement parks have become increasingly popular. The ride attractions in such theme or amusement parks typically involve vehicles such as roller coaster type cars, rail cars, automobile type cars and the like which move along enclosed or continuous loop paths either on their own wheels or on a subcarriage or other support. Water ride attractions similarly have water vehicles, for example boats, submarines or flume vehicles moving through a water filled channel or flume path. In general, the vehicles in these types of ride attractions have seats for several passengers. The passengers step into the vehicle to seat themselves. At the end of the ride, the passengers similarly step or climb out of the vehicle.

In order to obtain access to the seats for such rides, the passengers must be able to walk, step up, step down or to one side with at least a nominal level of agility. As a result, the disabled persons are largely prevented from enjoying these types of theme park ride attractions. Wheel chair users and others having limited mobility while increasingly gaining access to public and private buildings, transportation systems and other facilities remain virtually excluded from most if not all of the premier attractions at amusement and theme parks.

In addition to the foregoing, when a disabled person such as a paraplegic is to receive physical therapy, such is generally provided either by placing the individual on a table or placing the individual on a mat on the floor. Typically in order to have the disabled person transported from the wheel chair to the table or the mat, the physical therapist must lift the disabled person from the wheel chair onto the table or onto the mat. This typically is very difficult for the physical therapist and in many instances the physical therapist does not have the strength to accomplish this and in any event the disabled person is ill at ease by such movement.

As a result of the foregoing, there is a need for a transfer accessible vehicle which will allow the disabled person in a wheelchair to be positioned such that the person may maneuver themselves from the wheel chair onto such a transfer accessible vehicle and from the transfer accessible vehicle onto a seat in a ride in a theme or amusement park or alternatively to a table or mat where a physical therapist may provide the physical therapy.

SUMMARY OF THE INVENTION

A transfer accessible vehicle for a disabled person such as a paraplegic which includes an electrically powered self-propelled vehicle having a chassis, drive wheels, a steering wheel, a control module operable by an attendant and a fixed frame secured to the chassis, a lifting frame carried by the fixed frame, a chair mount secured to the lifting frame, a chair secured to the chair mount and means for vertically moving the lifting frame to position the chair at wheel chair height and subsequently at a height where the disabled person can transfer from the chair to the desired destination.

DETAILED DESCRIPTION

Figure 1:
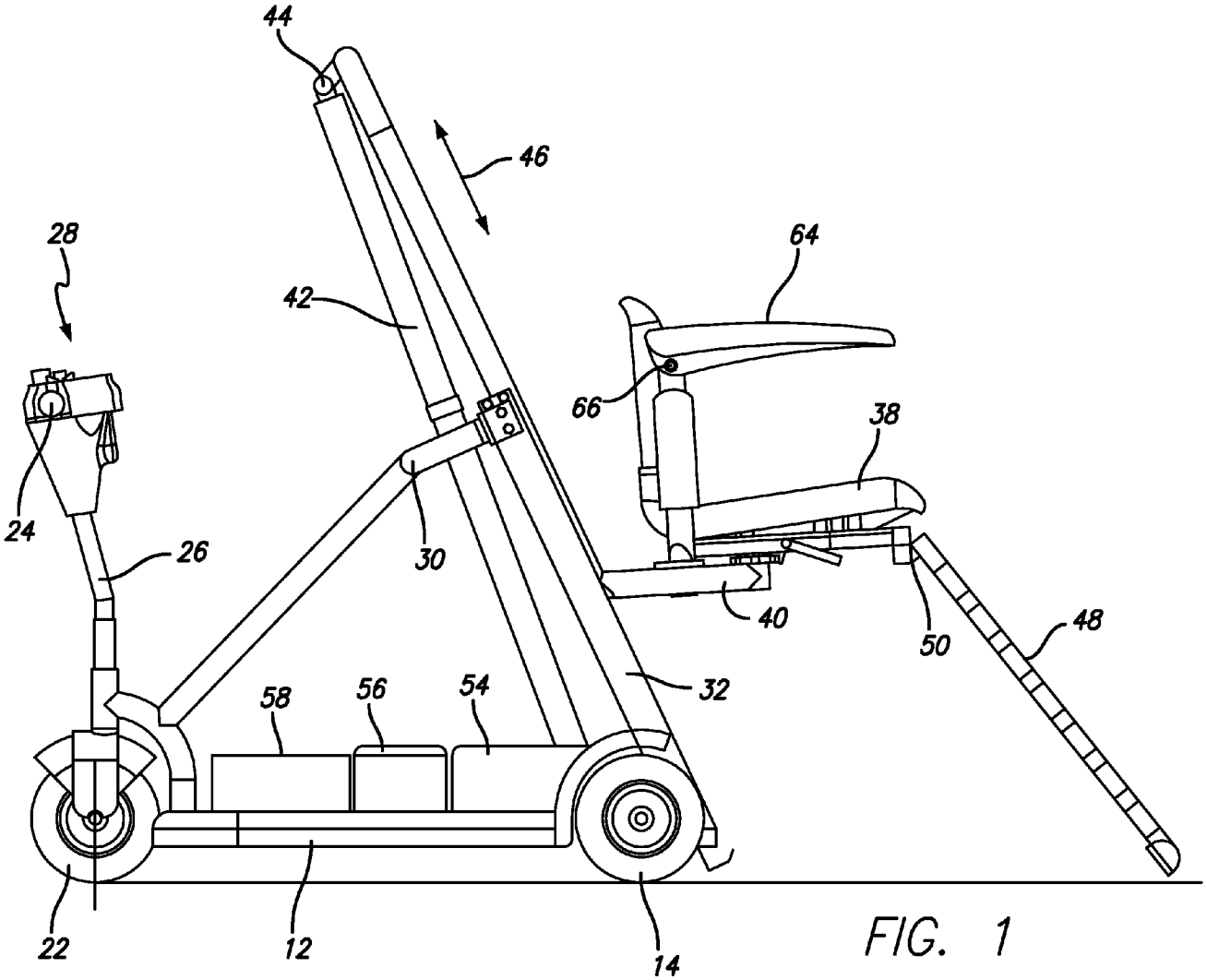
FIG. 1 is a schematic elevational view of the vehicle of the present invention where the chair is mounted at wheelchair height.

The American Disabilities Act (ADA) contains certain provisions and the regulations implementing them expand on those in such a way that if a new attraction at a theme or amusement park cannot accept a wheelchair then the operator must provide a transfer accessible vehicle which allows the disabled guest to transfer from the wheelchair to the attraction and back without the aid of an attendant other than positioning some type of device to accomplish this. U.S. Pat. No. 5,884,563 discloses a system in which one of the seats in a vehicle of a ride in a theme or amusement park is modified so that it includes a seat mover so that the physically disabled passenger is moved to a loading position and a post lifts the seat enough to clear the side of the vehicle. The seat is then swung into position so that the disabled passenger can move onto the seat after which the seat is swung back into position in the vehicle and lowered on the post and locked into position in the vehicle. U.S. Pat. No. 6,074,306 discloses a system for complying with the ADA wherein the last seat in an amusement or theme park ride is altered to accept a disabled person by lifting the seat upwardly and then lowering the seat after the person is seated on the seat. For the physically disabled person to move from the wheelchair to the seat there is provided a slide which is attached to the vehicle seat so that the disabled person may move from the wheelchair onto the seat. In each of these instances at least one seat of a vehicle in the theme or amusement park ride has to be radically modified such that its use for other persons is eliminated to accomplish the transfer of the disabled person from the wheelchair to the ride. In the theme or amusement park industry a principal goal of any handicap access device is to provide access without losing capacity. That is, do not create a device that necessitates the declination of a seat in a vehicle in the ride therefore reducing the throughput of the attraction. As noted from the foregoing discussion, the disclosure of the prior art patents U.S. Pat. Nos. 5,884,563 and 6,074,306 each require the declination of a seat in a vehicle to provide handicap access.

The present invention provides a solution to this problem which does not require modification of any of the seats in the vehicle at the amusement or theme park ride. This is accomplished by providing a self-propelled apparatus which is operable totally independent from the vehicle in the amusement or theme park ride. The disabled person transfers himself or herself from a wheelchair onto the self-propelled apparatus. The apparatus allows the disabled person to be either lowered to a dock height for entry into a vehicle that is positioned at dock height such as a boat or sled that is track mounted or alternatively to be raised to an elevated position for transfer into a raised vehicle. The apparatus of the present invention will also allow the disabled person to be lowered or raised from a wheelchair height onto a mat which is on the floor or upon a table for the purpose of engaging in physical therapy. Once the disabled person is positioned at the desired height, then the disabled person can transfer from the apparatus to the desired ride, mat or table.

The term "disabled person" as used throughout the specification and claims means an individual who has sufficient strength in his or her upper body and an arm or arms to be able to move from a seated position in a wheelchair to a different position out of the wheel chair without assistance. Such an individual is typically a paraplegic but need not necessarily be such. The term as used herein does not include an individual which requires assistance from another person to move from the wheelchair to a different position or from that different position back into the wheel chair. The different position may be for example only the chair on the transfer accessible vehicle of the present invention.

Figure 2:
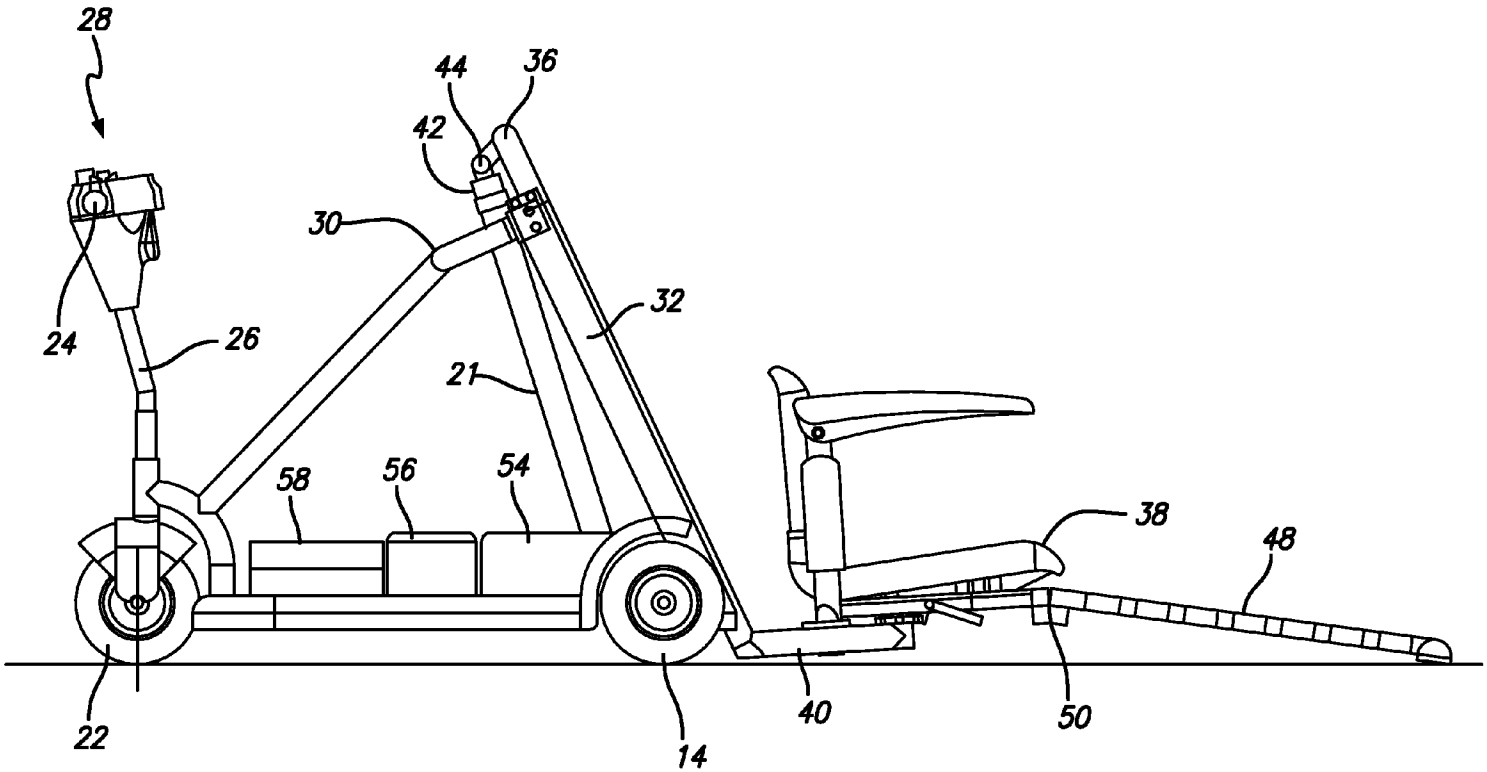
FIG. 2 is a right side elevational view showing the vehicle of the present invention with the chair in the lowered position.
Figure 3:
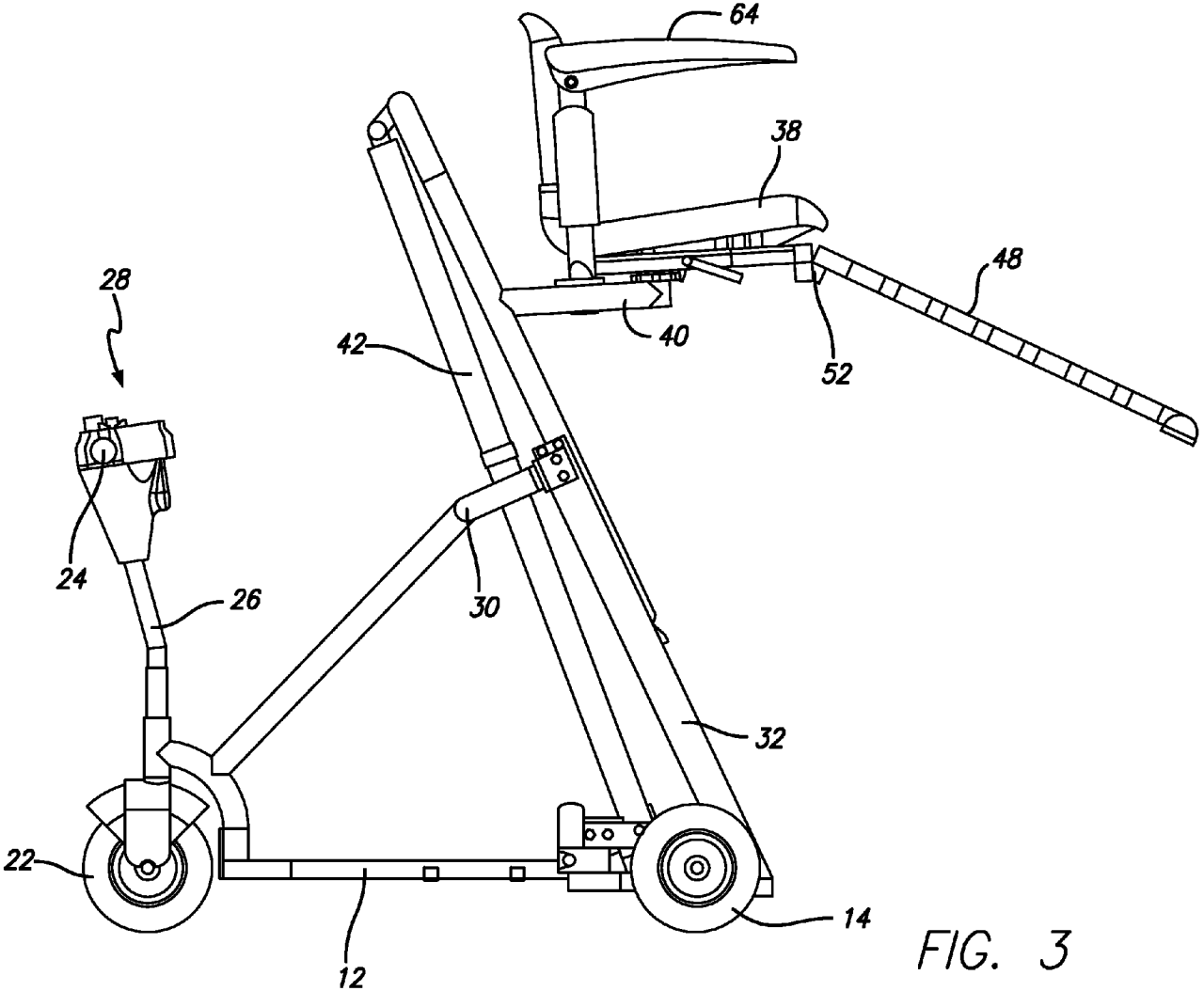
FIG. 3 is a right side elevational view of the vehicle of the present invention with the chair in the elevated position.
Figure 4:
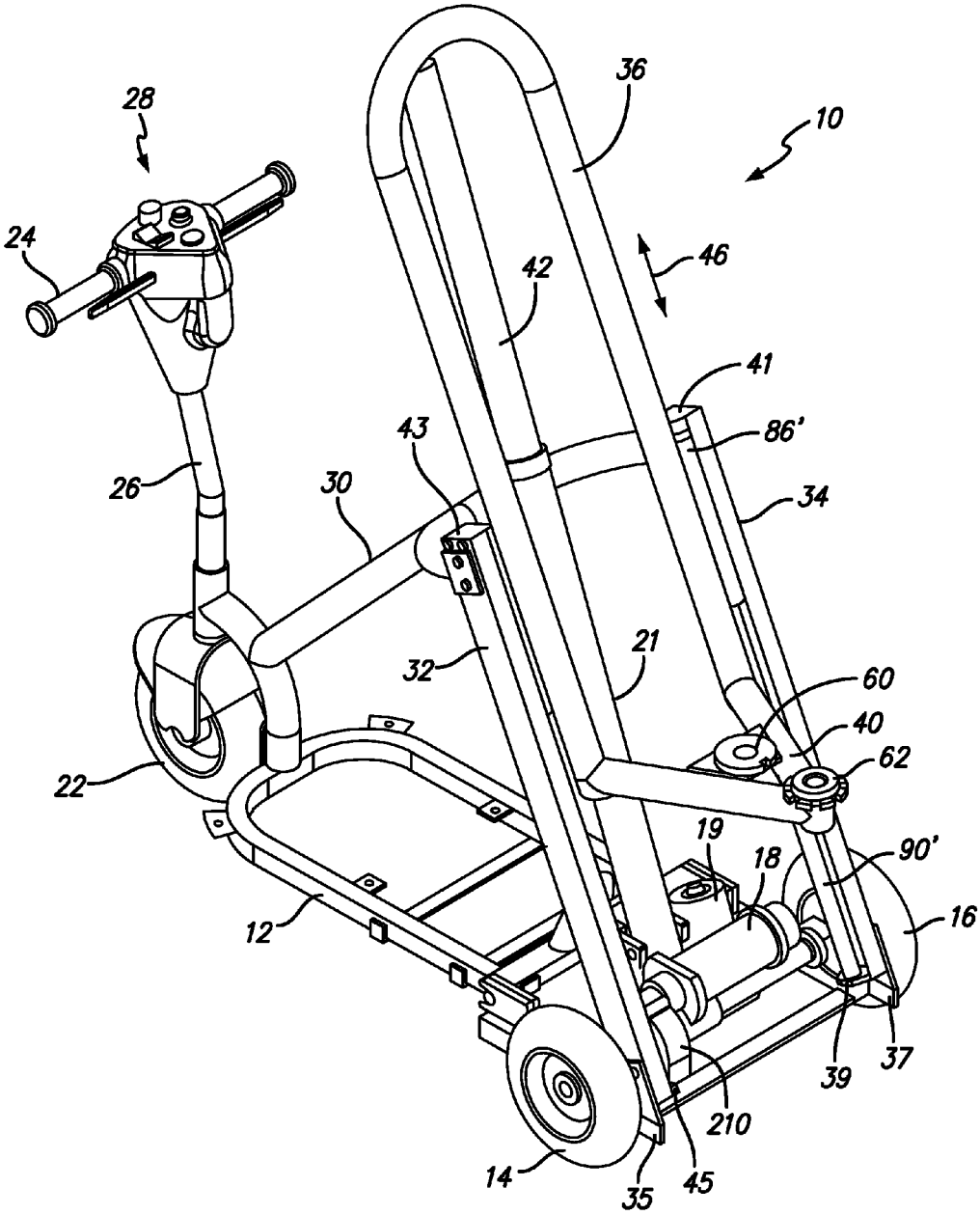
FIG. 4 is a perspective view of the vehicle with the chair and other items removed for clarity of illustration.

Referring now particularly to FIGS. 1 through 4, there is illustrated a transfer accessible vehicle 10 constructed in accordance with the principles of the present invention. The vehicle 10 includes a chassis 12 to which drive wheels 14 and 16 are attached. An electric motor 18 is connected through a gear train 20 to drive the wheels 14 and 16 as is well known to those skilled in the art. Also attached to the chassis 12 is a steering wheel 22 which is connected to a handlebar 24 by a column 26. Mounted on the uppermost part of the column 26 are appropriate controls 28 which will allow manipulation of the transfer accessible vehicle 10 and which will be described in more detail below. A fixed frame 30 is also connected to the chassis 12. The fixed frame 30 includes first and second lifting frame guides 32 and 34 respectively secured to opposite sides 35 and 37 of the chassis 12. A lifting frame 36 is connected by way of appropriate guide shafts and bearings carried by the lifting frame guides 32 and 34. One guide shaft 90' is shown in FIG. 4 and is connected between a lower bearing plate 39 and an upper bearing plate 41 affixed to and forming an integral part of the lifting frame guide 34. An upper bearing plate 43 and a lower bearing plate 45 are affixed to and form an integral part of the lifting frame guide 32. An additional guide shaft 90 (shown in FIG. 9) is connected between the upper and lower bearing plates 43 and 45. The guide shafts are received within a bearing member contained within a housing such as shown at 86' in FIG. 4 that is coupled to the lifting frame 36 by being permanently secured thereto. By being permanently secured to the bearing housing, the lifting frame is caused to move vertically to position the chair 38 as desired. This structure is illustrated in greater detail in FIGS. 8 and 9.

Figure 4A:
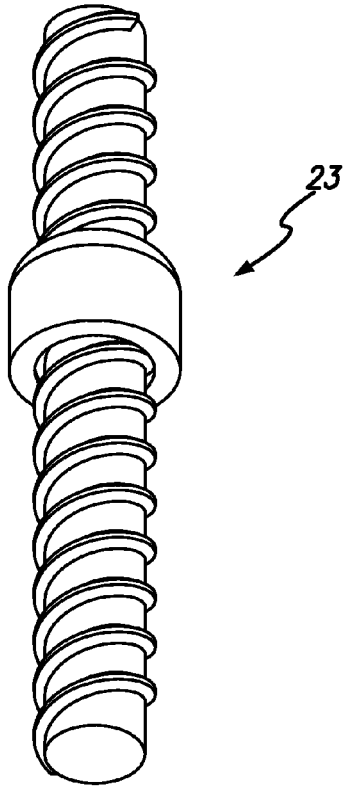
FIG. 4A is a perspective view of a lead screw assembly.

A chair 38 is mounted upon a chair mount 40 which is attached to the lifting frame 36. Force generating means 42 is connected between the lifting frame 36 as shown at 44 and the chassis and when activated will move the lifting frame either up or down as shown by the arrow 46. The force generating means 42 may be any apparatus which will effect movement of the lifting frame 36 vertically and, for example, may be a motor driven lead screw, a hydraulic actuator, a pneumatic actuator, a ratchet mechanism or the like. In the preferred embodiment, a motor driven lead screw is utilized. As is shown in FIG. 4, a motor 19 drives a lead screw housed within a cylinder 21. As the lead screw rotates the member 42 moves up or down within the cylinder 21 depending on the direction of rotation of the lead screw to move the lifting frame 36 up or down. FIG. 1 shows the lifting frame extended upwardly and FIG. 2 shows the lifting frame positioned in its downward position. The lead screw mechanism may be any known to those skilled in the art such as that shown at 23 in FIG. 4A as one example. A leg rest 48 is pivotally attached at 50 to the front of the chair 38. The pivotal attachment of the leg rest allows the leg rest to move outwardly and support the legs of the person sitting in the chair when the chair is lowered, for example, to floor level as is shown in FIG. 2. If desired, the connection 50 of the leg rest 48 to the front of the chair 38 may have an appropriate stop mechanisms 52 as shown in FIG. 3 affixed thereto to prevent the leg rest 48 from dropping vertically downwardly thus enabling the legs of the individual seated within the chair 38 to be extended outwardly in a more restful position if such is desired. This is illustrated better in FIG. 3 which illustrates the chair 38 having been elevated to an upward position as compared to the wheelchair height shown in FIG. 1 or the floor level as shown in FIG. 2. When the chair is elevated as shown in FIG. 3, it would then permit the individual to transfer into a vehicle such as a truck or automobile or alternatively to a table for receiving physical therapy.

Also positioned upon the chassis 12 are electrical controls 54, a battery 56 and a counterweight 58. The counterweight 58 is utilized to compensate for the load of a disabled person sitting in the chair 38 and the tendency to cause the vehicle to tip forward as a result of the forces created by the weight of the person disposed at various elevated positions. Although not specifically shown in the drawings it will be understood by those skilled in the art that appropriate electrical wiring would extend from the controls 28 to the electrical controls 54 and to the motor 18 and other mechanisms in order to cause the transfer accessible vehicle 10 to function as desired.

With specific reference to FIG. 4, the chair mount includes two positions 60 and 62 which are adapted to receive the chair 38. The chair mount position 62 functions to allow the chair 38 to be pivoted by incremental amounts as will be discussed more fully below. The position 60 is a non-pivoting position to which the chair is attached. The chair as shown in FIGS. 1, 2 and 3 is attached to the non-pivoting position 60 which will be the position that the chair is normally mounted in on the chair mount 40.

The chair 38 also has a pair of arms, one of which is shown at 64. The arms are each pivotally attached to the chair as shown at the position 66 so that the arms such as the one shown at 64 may be rotated upwardly as viewed in FIGS. 1, 2 and 3 to allow the disabled person to easily move from his or her wheelchair onto the chair 38 from either the right or the left side as may be desired.

Figure 5:
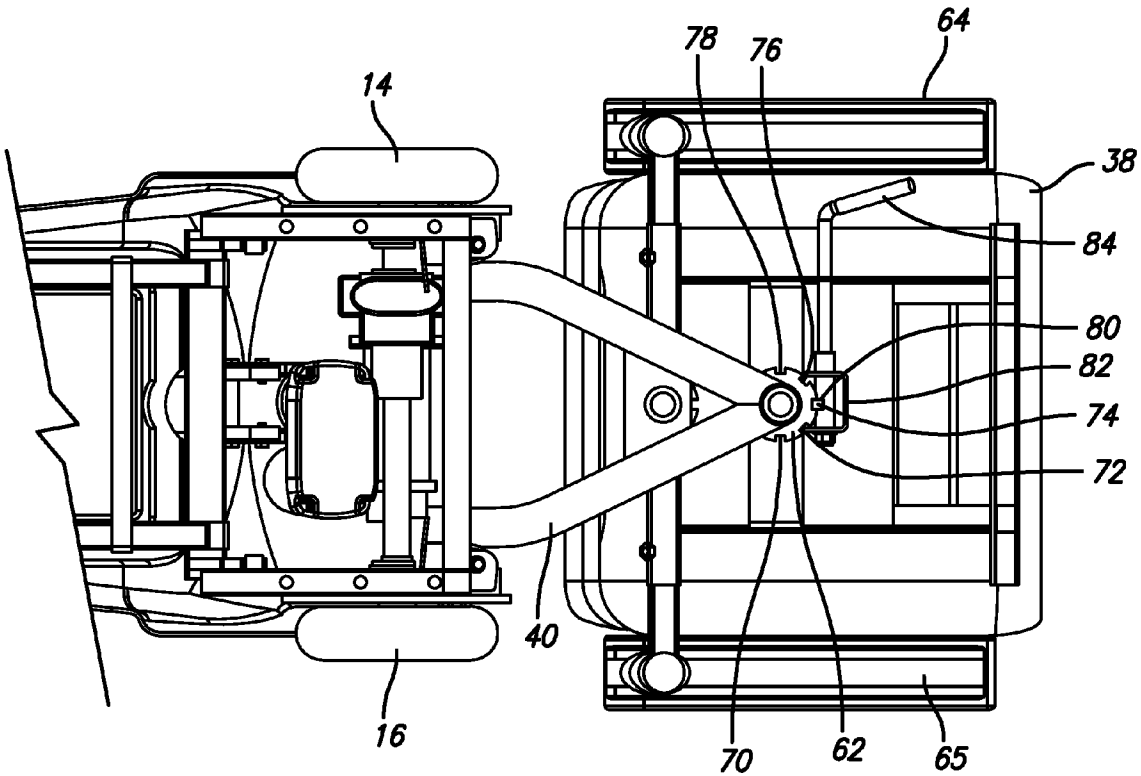
FIG. 5 is a view looking up from the bottom showing the chair in a normal position.
Figure 6:
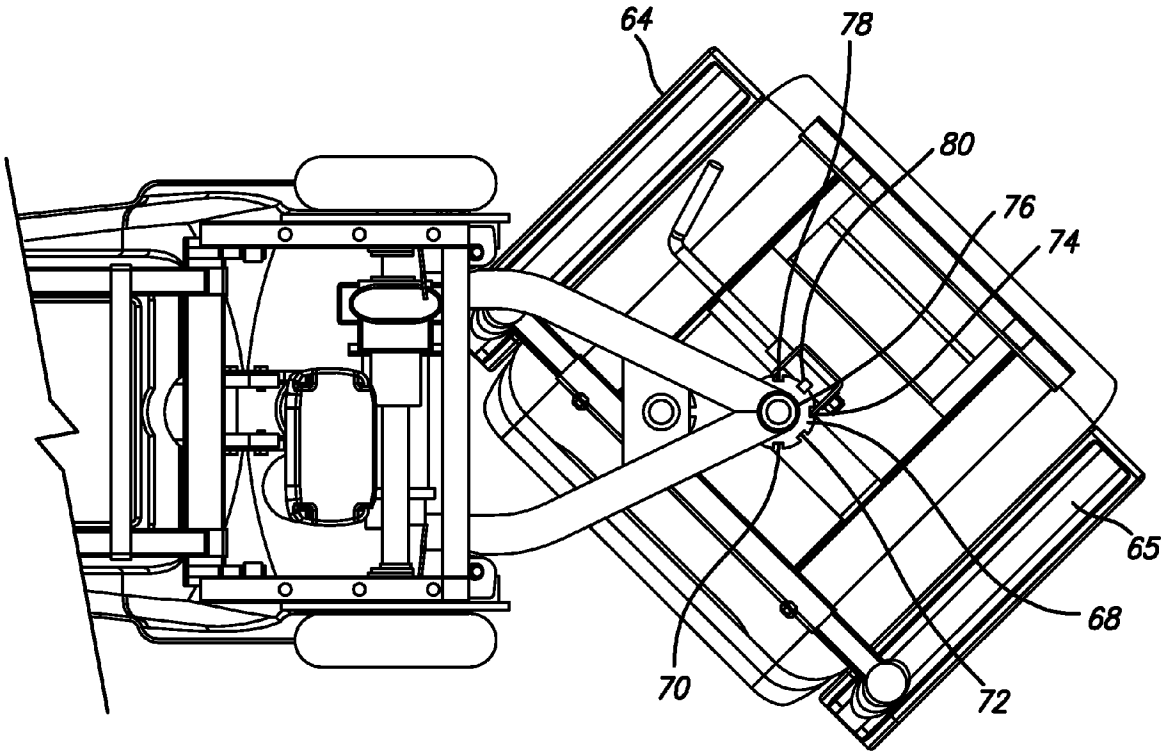
FIG. 6 is a view looking up from the bottom showing the chair rotated 45°.

Referring now more particularly to FIGS. 5 and 6, the chair mount position 62 is illustrated with the chair 38 being affixed thereto. As is clearly illustrated, the chair mount position 62 constitutes a circular plate 68 having a plurality of spaced-apart notches such as shown at 70, 72, 74, 76 and 78 which allow the chair to be rotated to various positions as may be desired for access to various rides or attractions. A locking member 80 extends into the notch 76 as shown in FIG. 6 to hold the chair at the rotated 45° position. As shown in FIG. 5, the locking member 80 extends into the notch 74 to hold the chair in its normal non-rotated position. A pivot release device 82 is connected to a handle 84 which is accessible by the disabled person utilizing the chair 38 to release the locking member 80 to permit the chair to be rotated in either direction that may be desired. As is also shown in FIGS. 5 and 6, there is an additional arm 65 for the chair and this arm as above indicated is also pivotally attached to the chair.

Figure 7:
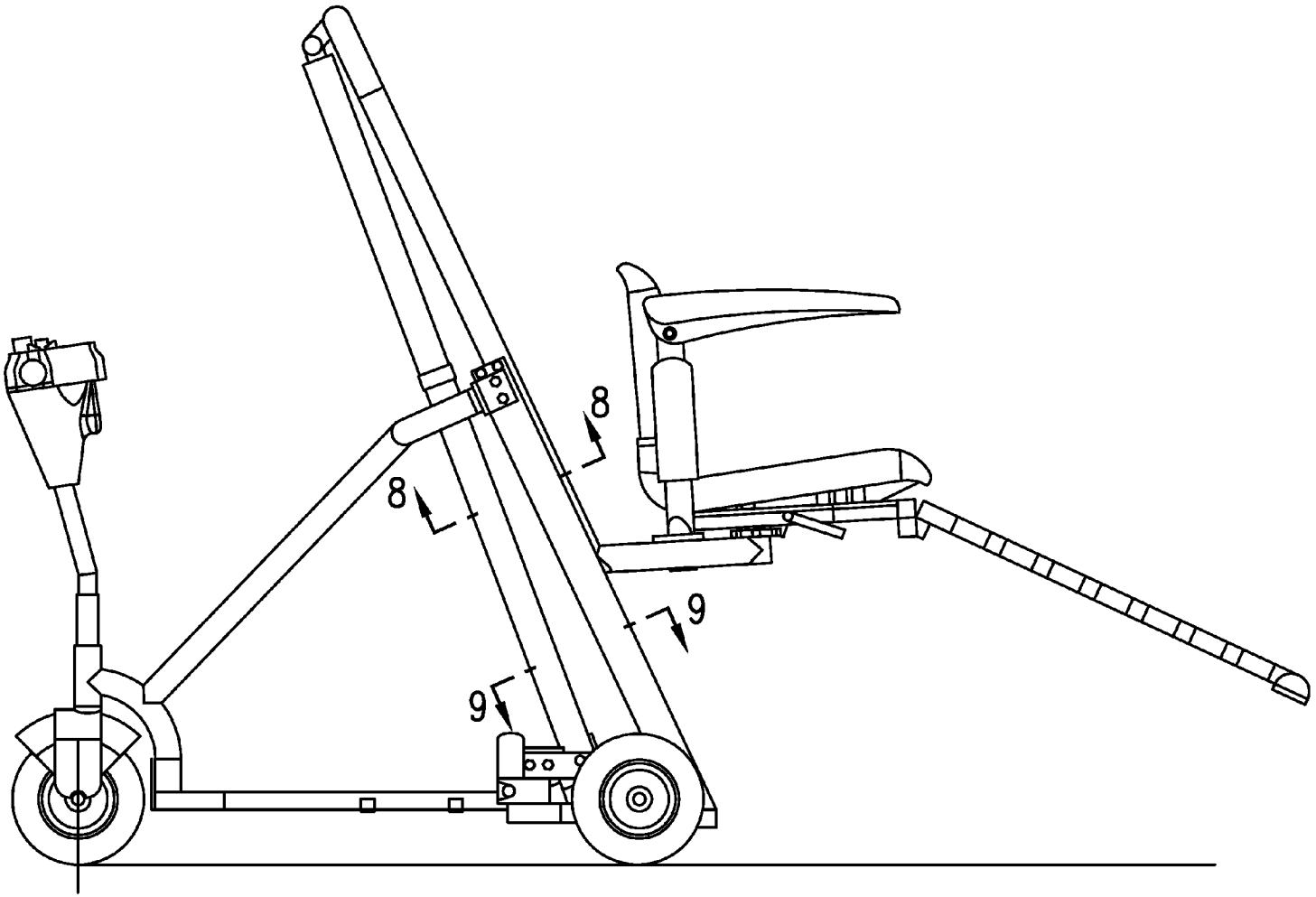
FIG. 7 is a view like that of FIG. 1 but providing cross sections taken about lines D-D and E-E.

Reference is now made to FIG. 7 which is very similar to FIG. 1 but with the counterweight battery ad electrical controlled boxes removed and is provided merely to show the position of the cross sections 8-8 and 9-9.

Figure 8:
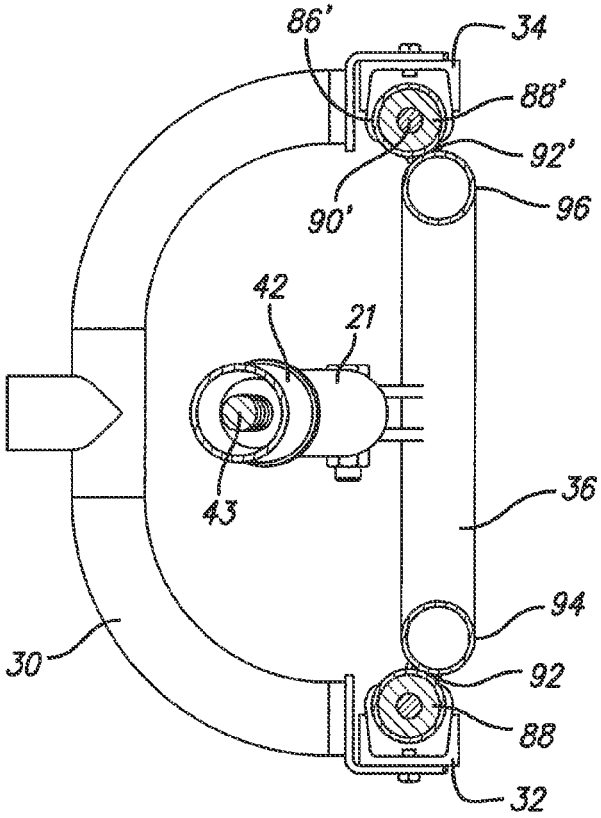
FIG. 8 is a view taken about the lines 8-8 of FIG. 7.

Reference is now made to FIG. 8 which is a cross-sectional view taken about the lines D-D of FIG. 7. As is illustrated in FIG. 8, a bearing housing 86 contains a bearing 88 within which a guide shaft 90 is positioned. The lifting frame 36 is permanently affixed to the bearing housing 86 as illustrated by the weld 92. The identical components of the bearing housing, bearing, guide shaft and weld are contained within the lifting frame guide 34 as is indicated by the same numerals being utilized but primed. Thus, with the two arms 94 and 96 of the generally U-shaped lifting frame 36 attached to the bearing housing 86-86', when the means for moving 42 is activated, the lifting frame 36 will move either up or down as indicated by the arrow 46 in FIG. 4 to move the chair 38 to the desired position to allow the disabled person access to the theme or amusement park attraction or positioned for therapy. A lead screw 43 is shown within the means for moving 42 and when it is rotated it moves the means 42 up or down within the cylinder 21 to position the chair 38.

Figure 9:
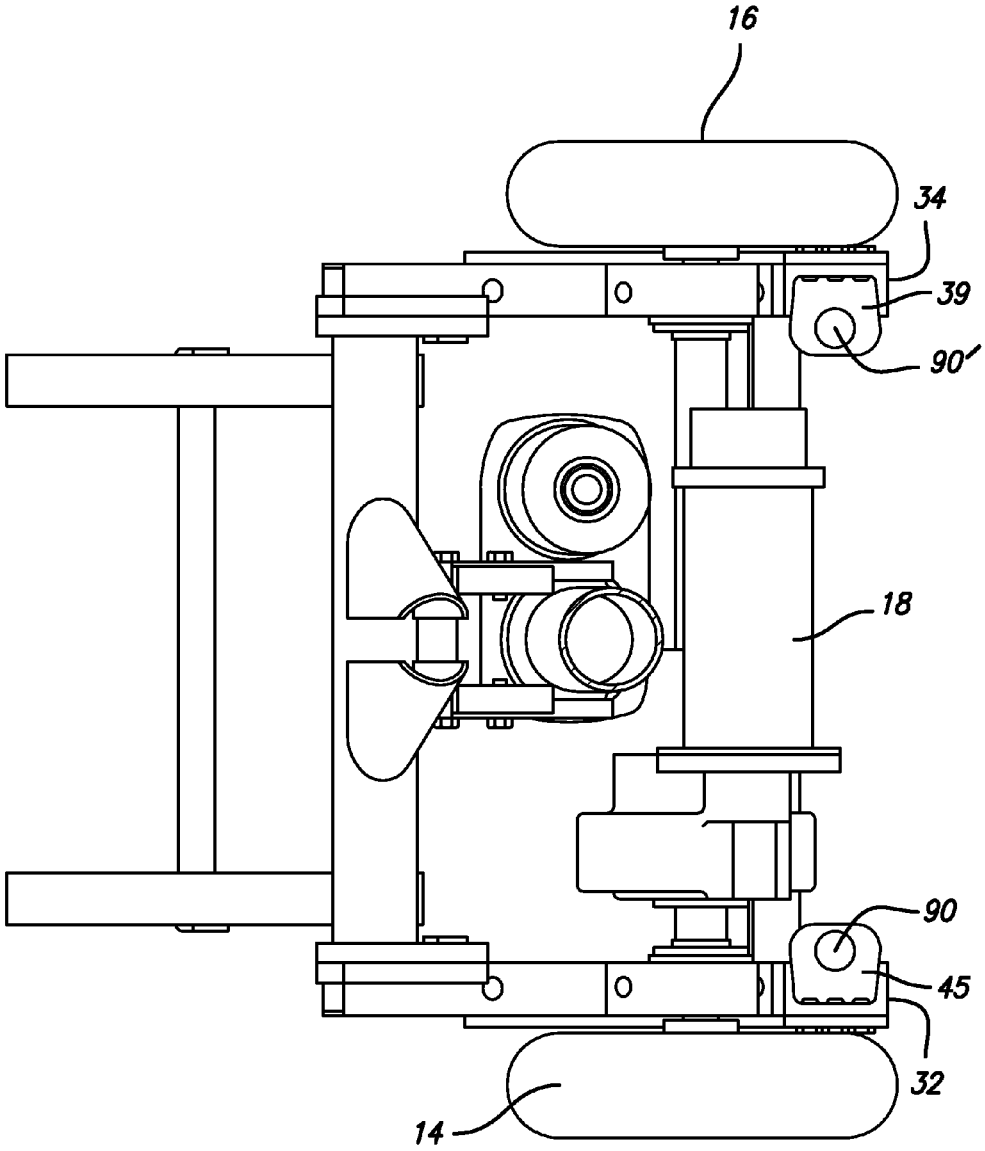
FIG. 9 is a view taken about the lines 9-9 of FIG. 7.

Reference is now made to FIG. 9 which is taken about the lines 9-9 of FIG. 7 and again shows the lifting frame guides 32 and 34 with the guide shafts 90 and 90' disposed within the bearing housing.

Figure 10:
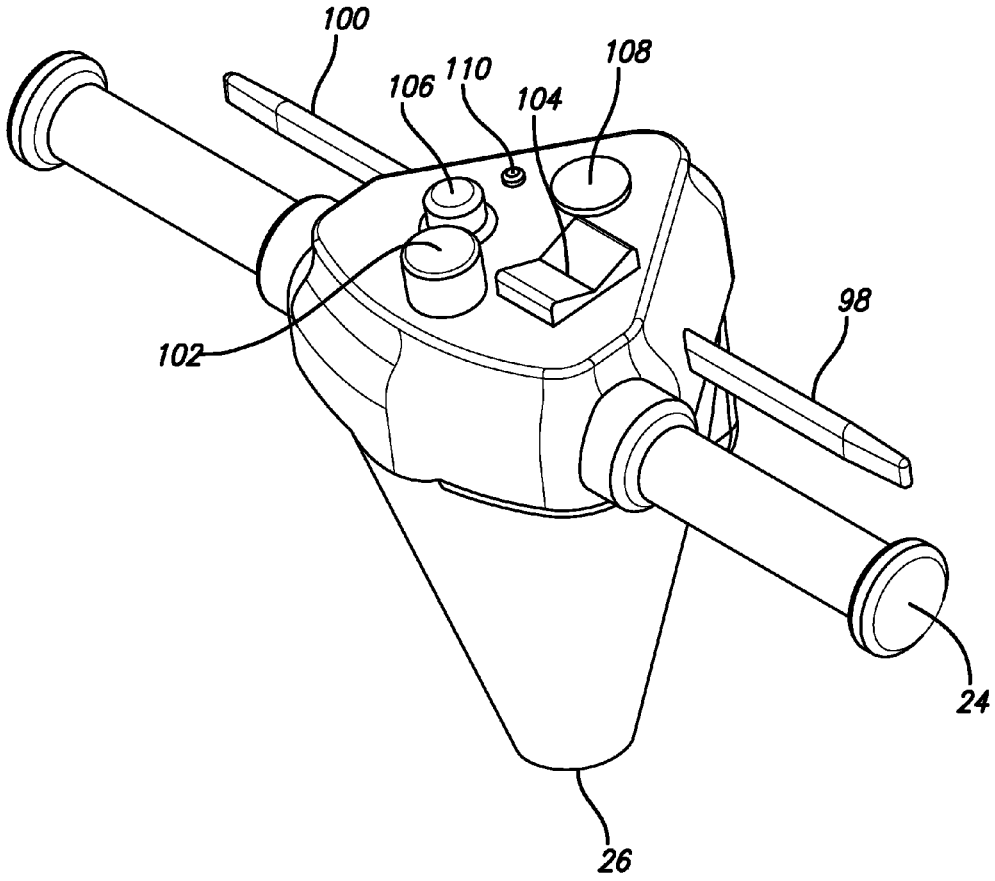
FIG. 10 is a schematic perspective view showing the controls for the vehicle of the preset invention.

Referring now more particularly to FIG. 10, the controls 28 are illustrated in additional detail. As is therein shown, there is a forward drive lever 98 and a reverse drive lever 100. Thus, when the operator grips the forward drive lever 98 and pulls it toward the handlebar 24, the transfer accessible vehicle 10 will move in the forward direction. Conversely, when the reverse drive lever 100 is pulled toward the handlebar 24, the vehicle 10 will move in the reverse direction. A speed control knob 102 is positioned such that it can be rotated in the clockwise direction to increase the speed with which the transfer vehicle moves either forward or in reverse. Conversely, if it is moved in the counterclockwise direction, the speed will be reduced. A switch 104 is provided so that when it is pressed downwardly by pressing on the forward facing portion thereof, the lifting frame will move upwardly and when it is depressed downwardly on the rear portion thereof, the lifting frame will move in a downward direction. An on/off indicator 106 is provided so that when it is lit, the operator will know that the device is ready for operation. There is also provided a battery charge indicator 108 so that the operator will know when the battery is useful for moving the vehicle. An on/off switch 110 is also provided so that when it is depressed, the unit is ready for operation and the on/off indicator 106 will light up.

Figure 11:
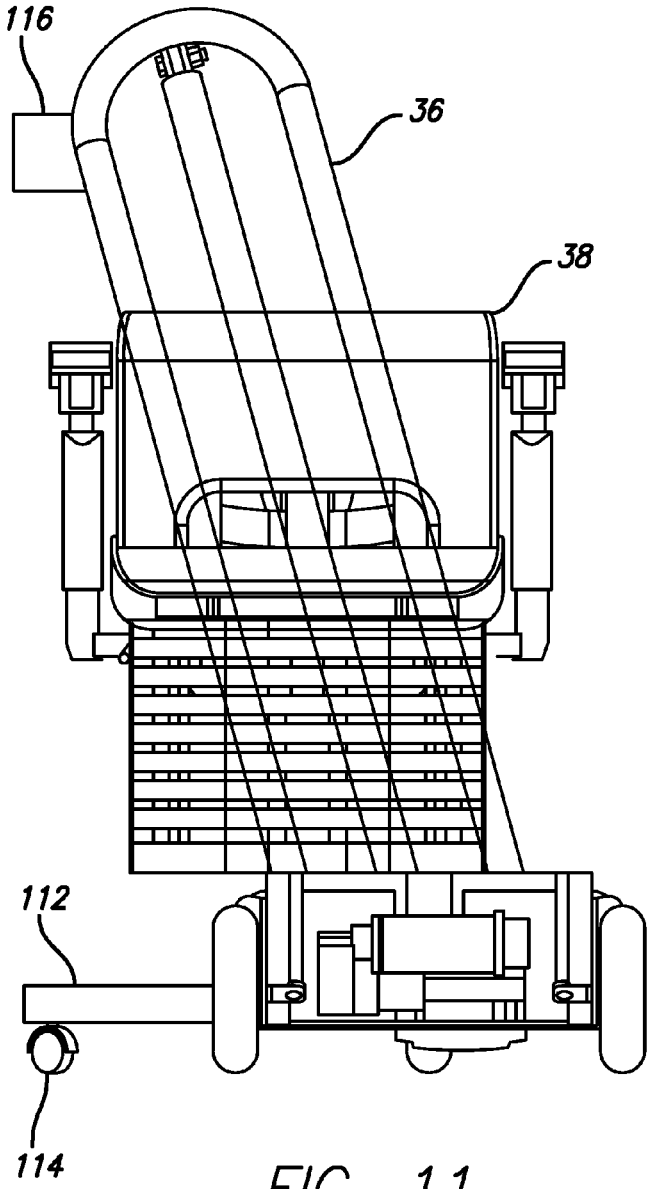
FIG. 11 is an alternative arrangement of the vehicle of the present invention.

Under some circumstances the transfer accessible vehicle may be utilized to position the disabled person adjacent a ride when there is a curb or a running board or other obstruction which would otherwise be an obstacle to preclude the positioning of the chair such that the disabled person could easily access a ride. In these circumstances, the fixed frame may be mounted in an inclined position or moved to an inclined position to provide for chair clearance under these circumstances and such is illustrated in FIG. 11 to which reference is hereby made. As is therein shown, the fixed frame carrying the lifting frame 36 is inclined at an angle such that the chair 38 can be moved upwardly while the chassis is positioned away from the obstacle which would otherwise prevent appropriate positioning of the chair. When the fixed frame and lifting frame are moved to the inclined position, the chair mount 60 or 62 to which the chair is affixed will be allowed to rotate slightly to maintain the chair such that the seat remains parallel to the surface on which the vehicle is positioned. This is required to keep the disabled person comfortable. Under these circumstances, there would also have to be an outrigger 112 which would include a roller or other member 114 which would contact the surface upon which the transfer accessible vehicle is riding so that as the chair 38 is moved upwardly with the individual seated therein, the weight of the individual in the position indicated as a result of the inclination would not cause the vehicle to tip over. It is also recognized that as the chair moves upwardly with the lifting frame 36, if it is against a vehicle or the like, the transfer accessible vehicle may tend to move as a result of the contact. As a result, there is provided a latching mechanism 116 which would contact the vehicle and cause a momentary attachment of the vehicle to the apparatus which the individual is attempting to move into. The latching mechanism 116 may be a mechanical apparatus that would affix itself to the vehicle to which the lifting frame is approaching or, alternatively, could be an electromagnet which, when activated, assuming that the vehicle is one which would accept a magnetic attachment, may also provide the desired stability for the transfer accessible vehicle under the inclined position as shown in FIG. 11.

Figure 12:
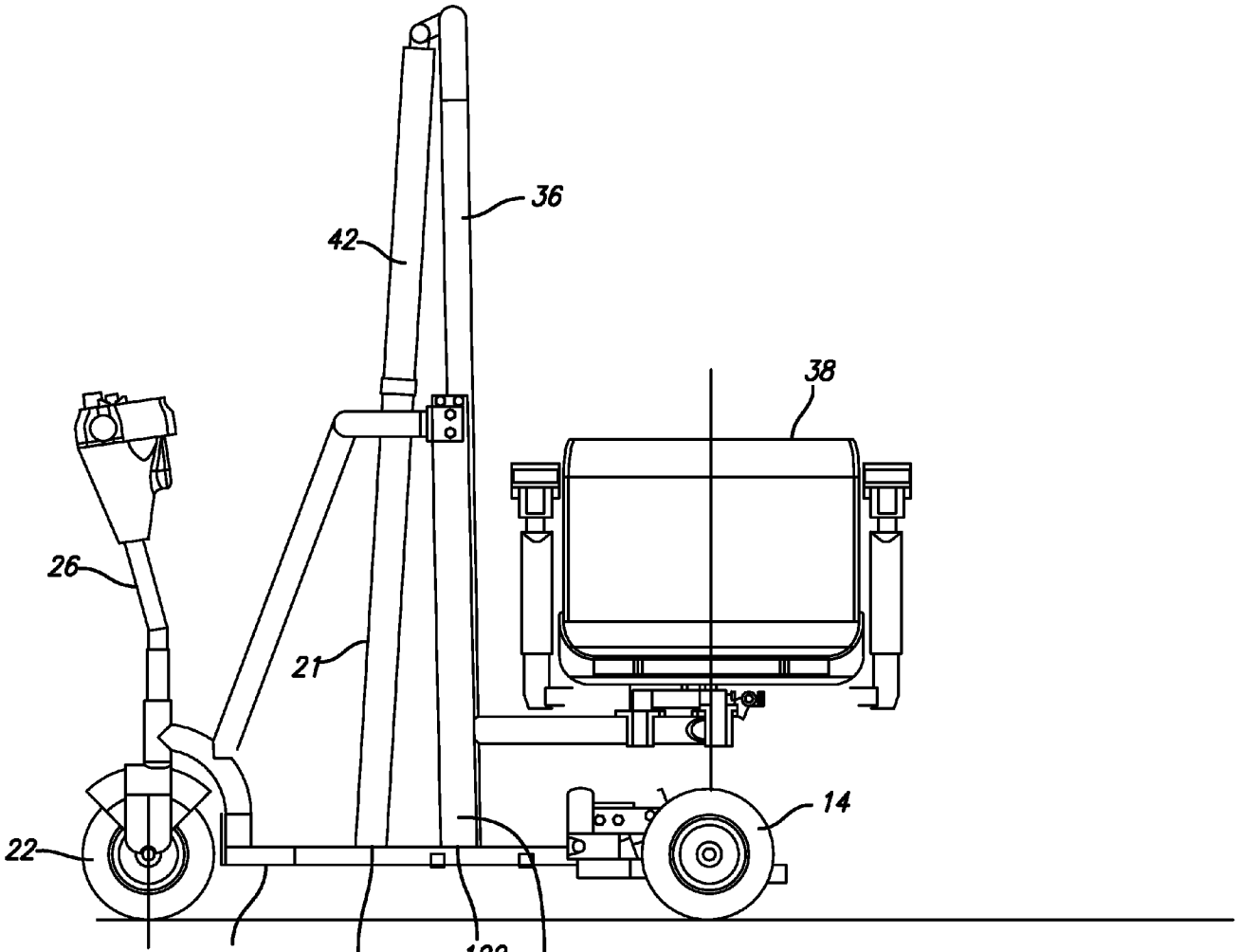
FIG. 12 is a right side view of an alternative embodiment of the vehicle of the present invention.

Referring now more particularly to FIG. 12, there is illustrated an alternative embodiment of the vehicle of the present invention. As is therein shown, the lifting frame guides 32 and 34 (only 32 shown) along with the lifting frame 36 have been positioned to a point 122 which is more toward the center of the chassis 12. The cylinder 21 and the member 42 have also been positioned to a point 120 more toward the center of the chassis 12. This positioning of the force generating means and the lifting frame approximately midway between the drive wheels and the steering wheel allows the chair 38 to be positioned approximately over the drive wheels. This arrangement enhances the stability of the transfer accessible vehicle of the present invention.

There has thus been disclosed a transfer accessible vehicle which may be positioned at wheel chair height so that a disabled person such as a paraplegic may easily transfer from the wheelchair onto the chair of the transfer accessible vehicle and then be independently transported to a desired destination such as a ride in an amusement or theme park. After arriving at the ride in the amusement or theme park, the chair on the transfer accessible vehicle may be positioned either in an upwardly or a downwardly directed position to bring the chair to a level such that the disabled person such as a paraplegic may then readily transfer himself or herself from the chair on the transfer accessible vehicle onto the seat or chair in the vehicle of the theme or amusement park ride. Alternatively, the chair may be positioned at the deck level so that the individual could transfer himself or herself onto a mat for physical therapy or if the physical therapist was using a table, it may be positioned so that the individual can transfer from the chair onto the table to receive the physical therapy.

What is claimed is:

1. A transfer accessible vehicle for a disabled person comprising:

(A) an electrically powered self-propelled vehicle operated by an attendant and having a chassis having first and second sides;

(B) drive wheels, a steering wheel, a control module operable by said attendant, and a fixed frame secured to said chassis;

(C) a lifting frame carried by said fixed frame;

(D) a chair mount secured to said lifting frame;

(E) a chair for use by said disabled person secured to said chair mount, said chair having a folding arm to permit said disabled person to transfer from a wheelchair to said chair; and (F) force generation means connected between said chassis and said lifting frame for vertically moving said lifting frame to position said chair at wheelchair height and subsequently at a higher or lower height where said disabled person can transfer from said chair to a desired destination.

2. A transfer accessible vehicle as defined in claim 1, wherein said chair mount includes first and second positions for securing said chair, said first position allowing said disabled person to pivot said chair and said second position securing said chair in a non-pivoting position.

3. A transfer accessible vehicle as defined in claim 2, which further includes a leg rest pivotally attached to a front portion of said chair, said leg rest extending outwardly as said chair is moved from said wheelchair height to a lower height.

4. A transfer accessible vehicle as defined in claim 1, wherein said lifting frame is generally U shaped having first and second arms, said fixed frame further includes first and second guide shafts for said first and second arms.

5. A transfer accessible vehicle as defined in claim 2, which in said first position, further includes a circular plate defining a plurality of spaced apart notches extending inwardly from the outer periphery thereof, a locking member extending into one of said notches to prevent pivoting of said chair, and a lever coupled to said locking member and accessible by said disabled person to remove said locking member from said one of said notches to allow said chair to pivot.

6. A transfer accessible vehicle as defined in claim 1 wherein said fixed frame includes a first lifting frame guide secured to the first side of said chassis and a second lifting frame guide secured to the second side of said chassis, first and second guide shafts secured within said first and second lifting frame guides, respectively, said lifting frame being coupled to said first and second guide shafts.

7. A transfer accessible vehicle as defined in claim 6 wherein said lifting frame guides each include an upper and a lower bearing plate, said first guide shaft being secured to said upper and lower bearing plates of said first lifting frame guide and said second guide shaft being secured to said upper and lower bearing plates of said second lifting frame guide.

8. A transfer accessible vehicle as defined in claim 7 which further includes first and second bearings surrounding said first and second guide shafts, respectively, and first and second bearing housings receiving said first and second bearings, said lifting frame being affixed to said first and second bearing housings.

9. A transfer accessible vehicle as defined in claim 1 wherein said chair includes first and second arms pivotally secured thereto and movable upwardly to permit said disabled person to have access to said chair from either side thereof.

10. A transfer accessible vehicle as defined in claim 3 wherein said leg rest further includes a stop member at said pivotally secured position to prevent said leg rest from dropping vertically downward.

11. A transfer accessible vehicle as defined in claim 1 wherein said control module includes individual levers accessible to an operator to maneuver said vehicle either forward or in reverse.

12. A transfer accessible vehicle as defined in claim 11 wherein said control module further includes a switch to activate said means for moving to cause said lifting frame to move either up or down.

13. A transfer accessible vehicle as defined in claim 1 wherein said fixed frame and said lifting frame are inclined from the vertical position to permit said vehicle to be positioned adjacent an attraction which includes an obstacle.

14. A transfer accessible vehicle as defined in claim 13 which further includes an outrigger affixed to said chassis and contacting the surface on which said vehicle rests to prevent said vehicle from tipping due to the weight of the disabled person being off center.

15. A transfer accessible vehicle as defined in claim 1 wherein said lifting frame and said means for moving said lifting frame are positioned at points relative to said chassis approximately midway between said drive wheels and said steering wheel.

16. A transfer accessible vehicle as defined in claim 15 wherein said fixed frame includes a first lifting frame guide secured to the first side of said chassis at a point approximately midway between said drive wheels and said steering wheel and a second lifting frame guide secured to the second side of said chassis at a point approximately midway between said drive wheels and said steering wheel, first and second guide shafts secured within said first and second lifting frame guides, respectively, said lifting frame being coupled to said first and second guide shafts.

17. A transfer accessible vehicle as defined in claim 16 wherein said lifting frame guides each include an upper and a lower bearing plate, said first guide shaft being secured to said upper and lower bearing plates of said first lifting frame guide and said second guide shaft being secured to said upper and lower bearing plates of said second lifting frame guide.

18. A transfer accessible vehicle as defined in claim 17 which further includes first and second bearings surrounding said first and second guide shafts, respectively, and first and second bearing housings, receiving said first and second bearings, said lifting frame being affixed to said first and second bearing housings.

* * * * *

UNITED STATES PATENT AND TRADEMARK OFFICE

CERTIFICATE OF CORRECTION

PATENT NO. : 8,783,403 B1
APPLICATION NO. : 14/076729
DATED : July 22, 2014
INVENTOR(S) : Lloyd L. Robbins It is certified that error appears in the above-identified patent and that said Letters Patent is hereby corrected as shown below:

On the Title page (71) Applicant: delete "Llyod" and insert -- Lloyd -- therefor.

Signed and Sealed this
Seventh Day of October, 2014

Michelle K. Lee

Michelle K. Lee
*Deputy Director of the United States Patent and Trademark Office*